United States Patent [19]

Sternlicht

[11] 4,052,610

[45] Oct. 4, 1977

[54] FLASHLIGHT CASE ASSEMBLY AND FLASHLIGHT

[75] Inventor: Mark Sternlicht, Stamford, Conn.

[73] Assignee: Wonder Corporation of America, Stamford, Conn.

[21] Appl. No.: 673,000

[22] Filed: Apr. 2, 1976

[51] Int. Cl.[2] ..... F21L 7/00

[52] U.S. Cl. ..... 362/200; 362/197

[58] Field of Search ..... 240/10.6 R, 10.6 SD, 240/10.6 CH, 10.61, 10.63, 10.65, 10.66, 10.67, 10.68, 6.4 R, 2.25

[56] References Cited

U.S. PATENT DOCUMENTS

| | | | |
|---|---|---|---|
| 2,119,486 | 5/1938 | Muldoon | 240/10.6 SD |
| 2,234,444 | 3/1941 | Martin et al. | 240/10.65 |

FOREIGN PATENT DOCUMENTS

| | | | |
|---|---|---|---|
| 1,434,401 | 2/1966 | France | 240/10.65 |

*Primary Examiner*—Russell E. Adams

*Attorney, Agent, or Firm*—Stephen E. Feldman; Marvin Feldman

[57] ABSTRACT

A front body assembly and rear body assembly, hingedly connected together at their bottom and detented at their top for selective opening and closing, co-operate with each other to form a flashlight case assembly which receives and mounts a flashlight bulb and dry cell battery to thus provide a flashlight. A reflector assembly, carried by the front body assembly, is formed with a substantially annular reflecting surface disposed about a substantially annular transparent area which, in turn, surrounds an opening centrally disposed to receive a flashlight bulb when such bulb is positioned on a component mounting plate assembly carried by the rear body assembly. An on/off switch is carried by a component mounting plate, of the component mounting plate assembly, for access through an aperture appropriately formed in the rear body assembly, and for co-operation with suitably disposed electrical conductors carried by the component mounting plate for coaction with each other and with the terminals of the dry cell battery. The component mounting plate is formed from transparent material so that when the flashlight bulb is energized by the battery its illumination can pass therethrough and through the rear body assembly which is formed from transparent or translucent material that is red in color so as to provide, when illuminated, a red caution or warning light if so desired. The opening and transparent area of the reflector assembly facilitate the availability of sufficient light from the flashlight bulb to so illuminate the rear body assembly. A bail is carried by the rear body assembly to help in positioning or carrying the flashlight. The exterior surface of the front body assembly is coated with phosphorescent material which will glow in the dark to aid in locating the flashlight.

13 Claims, 4 Drawing Figures

FIG. 1
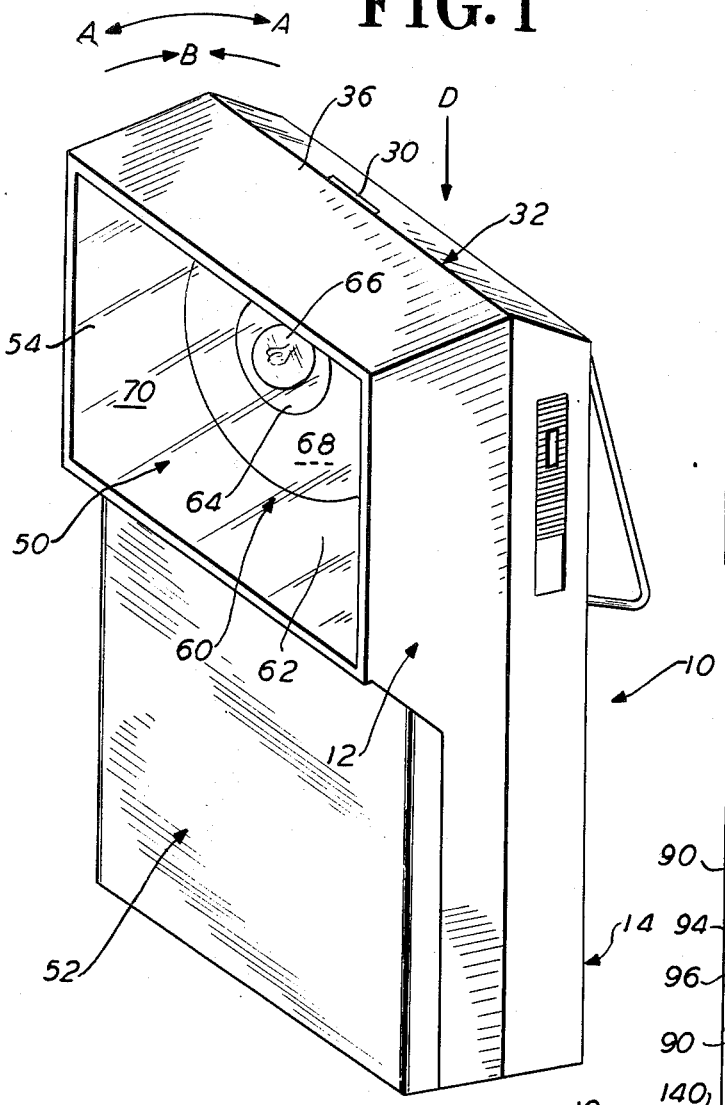
FIG. 3
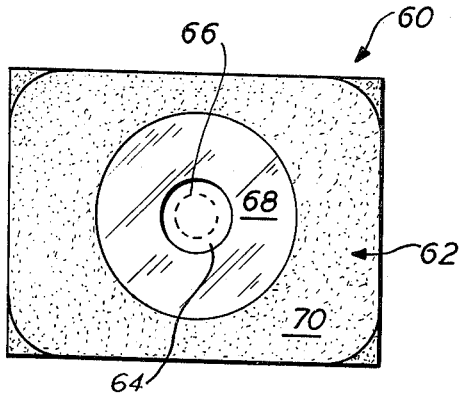
FIG. 2
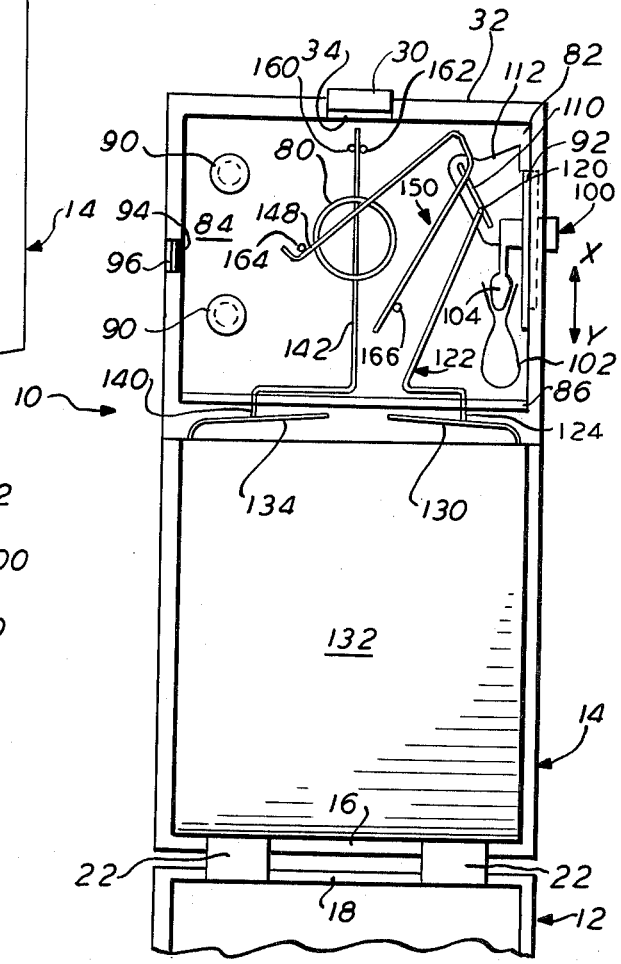
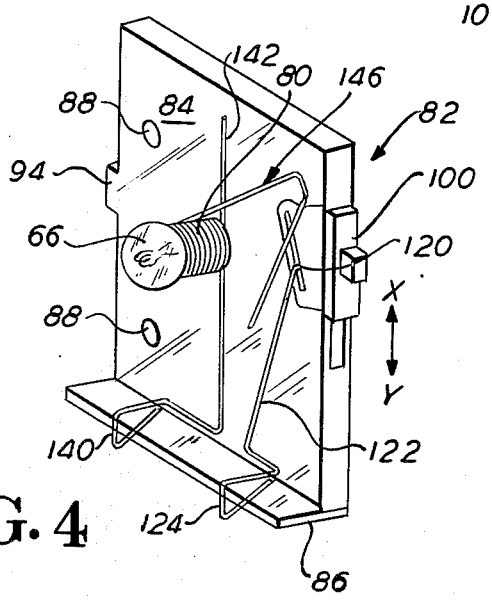
FIG. 4

FLASHLIGHT CASE ASSEMBLY AND FLASHLIGHT

BACKGROUND OF THE INVENTION — FIELD OF APPLICATION

This invention relates to flashlights and their cases, and more particularly to flashlight cases constructed to provide light of one color in a first direction and of another color in a second direction.

BACKGROUND OF THE INVENTION — DESCRIPTION OF THE PRIOR ART

Flashlights have been in use for a long time and much effort has been made to increase the versatility thereof to make them more useful.

More often then not, especially during the all too common re-occurance of brown-outs and black-outs that we experience today, one is forced to look for their flashlight in the dark because of the sudden failure of the regular lighting. One effort towards solving this problem is shown in U.S. Pat. No. 1,285,382 granted to Charles E. Renshaw on Nov. 19, 1918 for Attachment For Pocket or Portable Flash-Lights wherein there is attached to the exterior surface of a flashlight a holder within which is disposed a strip of luminous fabric. This construction, however, adds to the cost of construction of the flashlight by requiring the use of parts not otherwise needed, and also creates a case which is cumbersome and bulky and therefore more difficult to handle. An alternative approach is shown in U.S. Pat. No. 1,989,706 granted to William W. Lillard on Feb. 5, 1935 for Flash Light Lamp Detector, wherein a luminous element is removably screwed, or otherwise attached onto the rear end of a flashlight. Such a construction adds to the bulkiness of the flashlight and, in addition, may be easily lost if removed and thus not available to serve its intended purpose. Yet another attempt at solving the problem of locating a flashlight in the dark is that shown by Wilfred Schafer Stone in his U.S. Pat. No. 3,796,869 granted on Mar. 12, 1974 for Self-Illuminated Case. The thin and flexible material of Stone's case, which is internally coated with phosphorescent material, clearly detracts from the durability required for a flashlight; while internally coating same presents problems of cost which would be better if avoided in a flashlight where cost and accordingly price to the end user, must be kept low if one is to remain competitive.

The versatility of a flashlight can even be further increased if it can be made to provide more then one color of light. To construct a flashlight with multi-colored lenses, has been suggested in U.S. Pat. No. 2,070,472 granted on Feb. 9, 1937 to Elmer Criswell for Combination Flashlight and Emergency Traffic Signal; but such an approach is relatively expensive in construction because it requires elements not otherwise necessary for the flashlight. In addition the other colors are of limited size and their location is restricted to the front end of the flashlight. In U.S. Pat. No. 2,225,825 granted on Dec. 24, 1940 to Anthony J. Desimone for Flashlight the cylindrical member attached to the front of the flashlight provides a white light forward and red light about its periphery but here again the area which is illuminated red is of limited extent and located only to the front of the flashlight. To construct a flashlight with a white light to the front and a red light to the rear has been demonstrated by Samuel D. Sullam in his Swiss Pat. No. 223,425 granted on Dec. 1, 1942 but such a construction, by not providing a reflector behind the bulb, greatly diminishes the main purpose of the flashlight (i.e. to furnish a strong forwardly directed beam of light). Another prior art attempt at providing a bi-directional flashlight is shown in U.S. Pat. No. 3,252,235 granted on May 24, 1966 to Gerald A. Goessling and Arthur H. Moore for Flashlight. In such a device the rearwardly directed light, which is used to illuminate an advertisement, is provided only after a radical rearrangement and modification of the configuration of conventional flashlight components. The bulb mounting is not only impositive but is also relatively complex in use and construction. It furthermore requires a reflector which has a radical section completely removed and other portions of its area diminished in size to facilitate proper location of the bulb. This can only seriously affect the ability of the flashlight to provide a uniform forwardly directed beam which, after all, is one of the main purposes of the device.

SUMMARY OF THE INVENTION

It is therefore an object of this invention to provide a new and improved flashlight case assembly.

Another object of this invention is to provide a new and improved flashlight case assembly for a flashlight.

Yet another object of this invention is to provide a new and improved flashlight case assembly constructed to allow the illumination from the bulb to form not only a forwardly directed beam, but also to be emitted rearwardly to illuminate the rear of the case which is transparent and colored.

Still another object of this invention is to provide a new and improved flashlight case assembly which has at least part of its exterior surface coated with phosphorescent material to facilitate its location in the dark.

Yet still another object of this invention is to provide a new and improved reflector for a flashlight case assembly.

Yet still a further object of this invention is to provide a new and improved reflector for a flashlight assembly which reflector is formed with a centrally disposed aperture to facilitate disposition of the bulb, a transparent area about the aperture to facilitate emission of light from the bulb to the rear of the bulb, and a reflective surface about the transparent area to facilitate formation of a forwardly directed beam of light.

Yet still an additional object of this invention is to provide a new and improved component mounting assembly for a flashlight having bi-directional light emission.

Yet still another additional object of this invention is to provide a new and improved component mounting assembly for a flashlight which component mounting assembly is transparent to permit passage of light therethrough and thus emission of light bi-directional to the front and rear thereof.

The invention involves a flashlight case assembly with an opening for the passage of light through the front cover thereof and a colored and transparent rear cover between which are mounted the other components as well as a battery and bulb to be illuminated thereby. The bulb is mounted on a component mounting plate assembly for disposition through a centrally disposed aperture in a reflector. A transparent area is formed on the reflector about the aperture to permit light from the bulb to be emitted rearwardly thereof; while a reflective area is provided about the transparent area of the reflector to form a forwardly directed beam when the bulb is illuminated. The component mounting assembly is formed from transparent material to facilitate passage of the light from the bulb to the rear to illuminate the colored red cover of the flashlight case assembly.

Other objects, features, and advantages of the invention in its details of construction and arrangement of parts will be seen from the following description of the preferred embodiment when considered in conjunction with the drawing and the appended claims.

BRIEF DESCRIPTION OF THE DRAWING

FIG. 1 is a perspective view of the flashlight case assembly incorporating the instant invention to form a flashlight with a bi-directional illumination.

FIG. 2 is a front elevational view of the flashlight case assembly of FIG. 1 with its front body assembly pivoted to its open position and cut away in part to better show the internal components;

FIG. 3 is a front elevational view of the reflector assembly of FIG. 1 removed from the flashlight case assembly to better show its construction; and FIG. 4 is a perspective view of the component mounting assembly of the flashlight case assembly of FIG. 1 removed from the case to better show its construction.

DESCRIPTION OF THE PREFERRED EMBODIMENT

For convenience, the invention will be described as applied to a flashlight case assembly of generally rectangular configuration; which accepts a single rectangular dry cell battery; wherein the front body assembly and rear body assemby are hingedly connected along their respective bottom edges and detented for selective opening and closing at their respective top edges; having an on/off switch extending outwardly from the side of the rear body assembly; and wherein the rear body assembly is formed from transparent material which is red in color. It should be understood, nevertheless, that without departing from the scope of the invention, that the case assembly may be other then rectangular; and may be formed to accept two, three or more dry cell batteries of either rectangular or cylindrical configuration; that the front and rear body assemblies may be hinged along any convenient edge and detented in any appropriate and suitable manner, or for that matter interconnected by other means suitable to any selective opening and closing thereof which facilitates replacement of the bulb and dry cell battery or batteries as well as the case of the other internal components thereof; that the on/off switch may extend through any convenient portion of the case; and that the rear body assembly may be translucent instead of transparent and of any suitable and appropriate color.

With reference to FIG. 1 there is generally shown at 10 a flashlight case assembly having a first or front body assembly 12 and a second or rear body assembly 14 connected together along their lower edges 16, 18 by hinges 20, 22 which enable body assemblies 12, 14 to be rotated, in the direction of arrows A—A (FIG. 1), away from each other to open flashlight case assembly 10. A detent 30, integrally formed at a central portion of upper edge 32 of rear body assembly 14, is formed with a lip 34 (FIG. 2) for coaction with an upper edge 36 of front body assembly 12 to detent front body assembly 12 and rear body assembly 14 into a closed condition.

An opening 50, (FIG. 1) for the emission of light from flashlight case assembly 10, is formed in the upper portion of a front wall 52 of front body assembly 12. A clear transparent cover 54, of suitable plastic or glass, is fitted in conventional manner into opening 50. While a reflector assembly 60 (FIGS. 1 and 3) is suitably mounted within the upper inner portion of front body assembly for disposition behind cover 54 in opening 50.

Reflector assembly 60 is formed to a configuration proximating that of opening 50 and to a predetermined depth so as to provide a reflector assembly forward surface 62. The central portion of surface 62 has an aperture 64 formed therethrough sized to permit a conventional flashlight bulb 66 (FIGS. 1 and 3) to extend therethrough. Disposed about aperture 64 is substantially annular transparent or clear area 68 which, as will be explained later, permits light from bulb 66 when illuminated to pass rearwardly of bulb 66. A reflective surface 70, formed in any suitable conventional manner and disposed in a substantially annular configuration about clear area 68, is disposed to reflect light emitted from illuminated bulb 66 forward in a suitable configurated beam.

Bulb 66 is threadably received in an internally threaded boss 80 (FIGS. 2 and 4) formed on a component mounting assembly 82 which includes a rear wall 84 and a lower shoulder 86 both formed from transparent or otherwise clear plastic or other suitable material. A pair of apertures 88 are formed in rear wall 84 for location about a pair of lugs 90, formed on the inside surface of rear body assembly 14, to facilitate location of component mounting assembly 82 therewithin as shown in FIG. 2. A ridge 92 formed on rear body assembly 14 serves to keep one side of component mounting assembly 82 in position; while a detent 94, formed on the other side of mounting assembly 82, co-operates with a suitably disposed element 96 formed on rear body assembly 14 to securely position component mounting assembly 82 in position within rear body assembly 14.

An on/off switch assembly 100 is carried by component mounting assembly 82 for sliding movement in the direction of arrows X and Y. A spring like member 102 is carried by component mounting assembly 82 for coaction with a detent 104 carried by on/off switch assembly 100 in either an "on" or an "off" condition, as will be hereinafter explained.

A can slot 110 is formed in a plate 112 of on/off switch assembly 100 to receive a switch end 120 of a switch conductor wire 122, carried by component mounting assembly 82. A battery contact end 124, of conductor wire 122 is disposed about shoulder 86 of component mounting assembly 82 for electrical contact with a first flexible contact 130 (FIG. 2) of a dry cell battery 132. Dry cell battery 132 is of the flat rectangular type marketed by Wonder Corporation of America under their trademark ULTRA POWER. However, other suitable dry cell batteries, or for that matter, plurality of dry cell batteries with suitable electrical interconnections therebetween may be used. A second flexible contact 34 extends from battery 132 into contact with the battery end 140 of a bulb conductor wire 142 carried by component mounting assembly for contact with the base of a bulb 66 when positioned on mounting assembly 82. A bulb/switch conductor wire 146 is carried by component mounting assembly 82, so that a bulb contacting end 148 thereof is disposed to contact the side of a bulb 66 when positioned on mounting assembly 82. A switch end 150 of conductor wire 146 is disposed for contact with switch end 120 of conductor wire 122 as will be hereinafter explained.

A pair of lugs 160, 162 facilitate the mounting of conductor wire 142 on component mounting assembly 82; while a pair of lugs 164, 166 serve to position conductor wire 146 thereon. Component mounting assembly 82 is otherwise formed to provide a proper disposition of conductor wires 122, 142, and 146.

When preparing to use flashlight case assembly 10 one should first apply pressure to detent 30, in the direction of arrow D (FIG. 1), to release lip 34 thereof from beneath the underside of the inside of front body assembly 12 and permit the opening of case assembly 10 by moving front body assembly 12 and rear body assembly 14 about hinges 20, 22 away from each other in the directions of arrows A. A battery 132 should be positioned in rear body assembly 14 for coaction with conductor ends 124 and 140 as shown in FIG. 2 if an operative battery is not already so positioned. A bulb 66 should also be threaded into boss 80 of component mounting assembly 82 so that the base of bulb 66 contacts conductor wire 142 and so that the side of bulb 66 contacts conductor wire 148. It is presumed the on/off switch 100 has been previously moved in the direction of arrow X (FIG. 2) and that conductor wire 122 is out of contact with conductor wire 150 so that the circuit is open and bulb 66 is not illuminated.

Front body assembly 12 and rear body assembly 14 may thereafter be rotated about hinges 20, 22 towards each other in the direction of arrows B (FIG. 1) and case assembly 10 secured in closed condition by lip 34 of detent 30 catching on the inside of front body assembly 12.

On/off switch 100 may now be moved in the direction of arrow Y (FIG. 2) to turn the flashlight on. Movement of switch 100 in the direction of arrow Y carries with it plate 112 and effects a movement of conductor wire end 120 to the left (FIG. 2), due to the coaction thereof with slot 110 of plate 112, into engagement with conductor wire 150. The circuit between battery 132 and bulb 66 is thus completed and may be traced from contact 130 of battery 132 to conductor end 124, conductor 122, conductor end 120, conductor wire 150, the conductive side of bulb 66 and the element thereof, the conductive base of bulb 66, conductor wire 142, conductor end 134, and contact 134 of battery 132. On/off switch 100 is secured in either of its positions by coaction of detent 104 thereof with spring 102.

When bulb 66 has been so illuminated a significant amount of the light emitted thereby impinges upon reflective surface 70 to form a white beam of light (presuming that that is the color of bulb 66) directed through opening 50 and cover 54 thereof. Some of the light emitted by bulb 66 is also available to illuminate rear body assembly 14 which, as previously described, is formed in whole or in part from transparent or translucent material. Illumination of rear body assembly 14 is possible because light from illuminated bulb 66 is emitted rearwardly from bulb 66. The provision of aperture 64 and clear area 68 of reflector assembly 60 also facilitates the availability of sufficient light from bulb 66 to illuminate rear body assembly 14. The light thus available from illuminated bulb 66 is effective to so illuminate rear body assembly because component mounting assembly 82, which is disposed between bulb 66 and rear body assembly 14, is formed from clear or transparent material and the light from illuminated bulb 66 can pass therethrough.

One need only move on/off switch 100 in the direction of arrow X (FIG. 2) to move conductor end 120 away from conductor wire 150 and thus open the circuit and extinguish bulb 66.

Another important feature of this invention is that exterior surface 52 of front body assembly has applied thereto a conventionally phosphorescent or luminous material. This material may either be applied as a coating or by impregnating the material of front wall assembly with such a phosphorescent or luminous material during the fabrication thereof. As such flashlight case assembly 10 will glow in the dark and will be easy to locate for subsequent use.

From the above description it will thus be seen that there has been provided a novel and improved flashlight case assembly and flashlight which is simple in construction and use and which can provide light of one color in a first direction and light of a second color in a second direction.

It is understood that although I have shown the preferred form of my invention that various modifications may be made in the details thereof without departing from the spirit as comprehended by the following claims:

I claim:

1. A flashlight case assembly comprising:

a. a first body assembly of first predetermined configuration;

b. a second body assembly of second predetermined configuration;

c. said first predetermined configuration and said second predetermined configuration, of said first and said second body assemblies respectively, being such that when said first body assembly is disposed adjacent said second body assembly a component cavity of predetermined configuration is formed therebetween;

d. connecting means interconnecting said first body assembly and said second body assembly for relative movement with respect to each other to establish either a closed condition or an open condition therefore;

e. detent means carried by said first body assembly and said secured body assembly to retain same in said closed condition;

f. aperture means extending through a predetermined surface of said first body assembly;

g. reflector means disposed in said component cavity in alignment with said aperture means;

h. component mounting means disposed in said component cavity in alignment with said reflector means and formed to mount a light bulb for coaction with said reflector means so that when illuminated light from the light bulb coacts with a reflector surface formed on said reflector means to direct a beam of light of predetermined color through said aperture means;

i. said component mounting means further carrying electrical conductor means for coaction with an on/off switch means also carried by said component mounting means, for coaction with a bulb when mounted on said component mounting means, and for coaction with a dry cell battery when disposed in said component cavity to provide power means for illuminating the light bulb;

j. said component mounting means being formed of material which permits the passage of light therethrough and mounting the light bulb so that light emitted thereby can pass through said component mounting means; and k. said second body assembly being formed from material of a predetermined color and which also permits the passage of light therethrough in at least an area thereof proximate said component mounting means so that light emitted from a bulb and which passes through said component mounting means will illuminate said area of said second body assembly which permits light to pass therethrough.

2. The flashlight case assembly of claim 1 wherein said first predetermined configuration and said second predetermined configuration are both substantially trough like and are arranged so that when said first body assembly is disposed proximate said second body assembly said troughs together form said component cavity.

3. The flashlight case assembly of claim 2 wherein said reflector assembly is disposed within the trough of said first body assembly and said component mounting assembly is disposed within the trough of said second body assembly in a alignment with said reflector assembly.

4. The flashlight case assembly of claim 3 wherein said component mounting assembly carries a light bulb mounting means substantially in alignment with the center of said reflector assembly means and said reflector assembly means includes a bulb aperture through which a light bulb may extend when the light bulb is mounted on said component mounting means.

5. The flashlight case assembly of claim 4 wherein said reflector assembly includes a substantially annular first area completely surrounding said bulb aperture and which is formed to allow light to pass therethrough, and wherein said reflector assembly further includes a substantially annular second area completely surrounding said first area and which is formed so as to provide a light reflective surface.

6. The flashlight case assembly of claim 5 wherein said first area is transparent.

7. The flashlight case assembly of claim 1 wherein said predetermined color of said second body assembly is red.

8. The flashlight case assembly of claim 1 wherein said entire second body assembly is formed to permit the passage of light therethrough.

9. The flashlight case assembly of claim 8 wherein said entire second body assembly is formed from a transparent plastic material.

10. The flashlight case assembly of claim 1 wherein at least a portion of the exterior surface of said first body assembly is phosphorescent.

11. A flashlight case assembly including:

a front wall;

a rear wall;

side walls;

said front, rear and side walls forming a cavity;

transparent means positioned in said front wall;

reflector means disposed in said cavity in alignment with said transparent means;

component means disposed in said cavity and positioned to mount a light bulb for coaction with said reflector so that when illuminated, light from the light bulb coacts with a reflector surface formed on said reflector means, a beam of light is directed through said transparent means, said component means being further formed so as to permit light to be emitted sidewardly behind said reflector;

on/off means for coaction with a bulb and for coaction with a power source to provide power for illuminating the light bulb;

at least part of said side walls being formed from material which permits the passage of light therethrough so that light emitted from said bulb will pass through said side walls to provide illumination.

12. The flashlight case assembly of claim 1, wherein said rear wall is at least in part formed from material which permits the passage of light therethrough so that light emitted from said bulb will pass through said rear wall to provide illumination.

13. The flashlight case assembly of claim 12, wherein said side walls and said rear wall are an integral construction.

* * * * *